US005988063A

United States Patent [19]

Brandenburg et al.

[11] Patent Number: 5,988,063

[45] Date of Patent: Nov. 23, 1999

[54] PRINTING MACHINE WITH PRINTING GROUPS DRIVEN BY INDIVIDUAL ELECTRIC MOTORS

[75] Inventors: Günther Brandenburg, Gröbenzell; Stephen Geissenberger, Augsburg; Michael Schramm, Aindling; Nils-Hendric Schall, Augsburg, all of Germany

[73] Assignee: Man Roland Druckmaschinen AG, Offenbach am Main, Germany

[21] Appl. No.: 09/152,951

[22] Filed: Sep. 14, 1998

[30] Foreign Application Priority Data

Sep. 12, 1997 [DE] Germany ..... 197 40 153

[51] Int. Cl.[6] ..... B41F 5/04

[52] U.S. Cl. ..... 101/219; 101/183

[58] Field of Search ..... 101/219, 183; 318/803

[56] References Cited

U.S. PATENT DOCUMENTS

| | | | |
|---|---|---|---|
| 4,271,379 | 6/1981 | Eckelmeyer | 318/77 |
| 4,905,135 | 2/1990 | Unehara et al. | 363/98 |
| 5,272,428 | 12/1993 | Spiegel et al. | 318/803 |
| 5,826,505 | 10/1998 | Volz et al. | 101/183 |
| 5,826,508 | 10/1998 | Komori | 101/350.3 |

FOREIGN PATENT DOCUMENTS

| | | | |
|---|---|---|---|
| 43 22 744 | 1/1995 | Germany | 101/183 |

OTHER PUBLICATIONS

IFRA Newspaper Techniques, English Edition, Dec. 1991, pp. 1,3,68,69.

*Primary Examiner*—Edgar Burr
*Assistant Examiner*—Charles H. Nolan, Jr.
*Attorney, Agent, or Firm*—Cohen, Pontani, Lieberman & Pavane

[57] ABSTRACT

A printing machine driven by one electric motor or by individual electric motors controllable by their own respective associated control systems. The control systems contain a subsystem observer or a total system observer, which obtains from the actual rotational angle speed ($\omega_{ist}$) or the actual rotational angle ($\phi_{ist}$) as well as from the electric-current or moment target value or actual value of the electric motor, an observed load torque ($\hat{M}_{LAST}$), which is supplied to the adjustment element as a component of the target moment ($M_{soll}$). This signal can be applied via a differentiating filter or, in addition, via the proportional element, to the summing point. Alternatively to or in conjunction with the observer, a periodic compensation controller is provided in the control loop. The periodic compensation controller provides deviation-control for periodic disturbances and obtains, from the differential angular speed ($\omega_D$), a component ($M_{2soll}$) of the target load moment ($M_{soll}$). To improve signal quality, filters can be used.

7 Claims, 2 Drawing Sheets

100
23
24
25
26
27
28
29
30
31
32
33
34
35
36
37
38
39
40
41
42
43
OBSERVER
$\omega_{SOLL}$
$\varphi_{SOLL}$
$\omega_{2\,SOLL}$
$\omega_{1\,SOLL}$
$\omega_D$
$M_{2\,SOLL}$
$M_{SOLL}$
$M_{1\,SOLL}$
$M_{ELLE}$
$M_B$
$M_{LAST}$
$\omega_{IST}$
$\varphi_{IST}$
$\hat{\omega}_{IST}$
$\hat{M}_{LAST}$

PRINTING MACHINE WITH PRINTING GROUPS DRIVEN BY INDIVIDUAL ELECTRIC MOTORS

BACKGROUND OF THE INVENTION

1. Field of the Invention

The invention relates to a printing machine with printing groups or printing group parts driven by at least one electric motor.

2. Discussion of the Prior Art

In the simplest case, printing machines are driven by a single motor that drives a mechanical longitudinal shaft. In more advanced designs, the longitudinal shaft is broken up, and the resulting parts are driven by individual angle-controlled motors that operate in angle-synchronicity. In further configurations, printing units or even parts of printing groups, such as form cylinders or transfer cylinders, are driven by individual associated angle-controlled motors.

For example, a rotary offset printing machine with directly driven cylinders is known from the article "Direktantriebstechnik" ["Direct Drive Technology"] by F. R. Goetz in Antriebstechnik [Drive Technology] 33 (1994) No. 4, pp. 48 to 53. Printing machines of this type, driven by multiple motors in accordance with the individual drive principle, have a simpler mechanical structure than printing machines with a longitudinal shaft. Intermediate gearwheels and couplings between the individual printing groups or printing group units are omitted, as are circumferential register adjustments. The use of water-cooled motors of small structural size and optimal heat control allows the structure of such printing machines to be further improved. Because the components of the printing machine are mechanically disconnected, they cannot vibrate against each other. Moreover, the "virtual" coupling of printing groups to one another entails no additional mechanical expense. Particularly in printing machines for printing on webs, a large number of web guides can be realized simply.

All printing machines driven by electric motors experience periodic and non-periodic disturbances. The load torque reacting on an electric motor of the printing machine or the printing machine part (i.e., a cylinder, cylinder pair or group of cylinders or rollers) driven by that motor represents a disturbance variable in the control loop. Disturbances that occur periodically, e.g., the impacts in the inking mechanism of a vibrator, which executes a pendulum movement between an ink duct and an ink transfer roller, pose particular problems. Other periodic disturbances result, for example, from the cross-wise cutting of the printing web, from the movement of a folding blade in a knife folding mechanism that produces a third fold, from the channel impact associated with clamping channels in form and transfer cylinders, and from non-circularities in paper and transport rollers.

SUMMARY OF THE INVENTION

The object of the present invention is to provide a printing machine in which periodic and nonperiodic disturbances can be compensated for.

Pursuant to this object, and others which will become apparent hereafter, one aspect of the present invention resides in a printing machine having printing groups and at least one electric motor arranged to drive at least parts of the printing groups. A separate control loop is in operative communication with a respective motor so as to control the actual angular speed of the electric motor. Each control loop includes an observer for obtaining an observed target load from either the actual angular speed or the actual rotational angle as well as a target torque of the electric motor. The observer also obtains an observed angular speed that is added to a target angular speed.

In another embodiment of the invention, each control loop has a periodic compensation controller which compensates for periodic disturbances, such as the channel impacts of form and transfer cylinders, periodic disturbances of a vibrator in an inking mechanism, a cutting blade for cross-cutting a printing web, or a folding knife to produce a fold.

In still another embodiment of the invention the control loop includes filter means for damping resonance points in the actual angular speed, in the actual rotational angle and in the component of the target torque of the electric motor.

In yet another embodiment of the invention the observer or the compensation controller are embodied as learning-capable systems which are adapted in a controlled manner to the actual angular speed or the target angular speed. The observer and compensation controller can also be embodied as neural networks and/or fuzzy logic systems which implement an automatic adaptation of parameters.

In a printing machine, the parts driven by a single motor or by individual electric motors, e.g., a printing group driven by its own individual electric motor, a cylinder or roller pair driven by its own electric motor, or a roller or cylinder group driven by its own electric motor in, for example, a printing group, a cooling mechanism, a folding structure or a folding apparatus, represent multi-mass systems, the individual masses of which are connected to each other by gears in a positive-locking but elastic manner, or by pressure forces in a force-locking manner due to friction forces. The elasticity of, for example, intermeshing gearwheels must be taken into account. The teeth of the gearwheels act on each other elastically. The bearings of rollers and cylinders also react elastically. As a result, each subsystem has several resonance frequencies, which extend in range from approximately 1 Hz to approximately 100 Hz. If only individual cylinders, e.g., rubber-blanket cylinders or plate cylinders, are driven by their respective individual controlled electric motors, the resonance frequencies lie at higher values, i.e., in the range of approximately 100 Hz to 500 Hz.

The control of the drives takes resonance points as well as disturbance variables into account.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
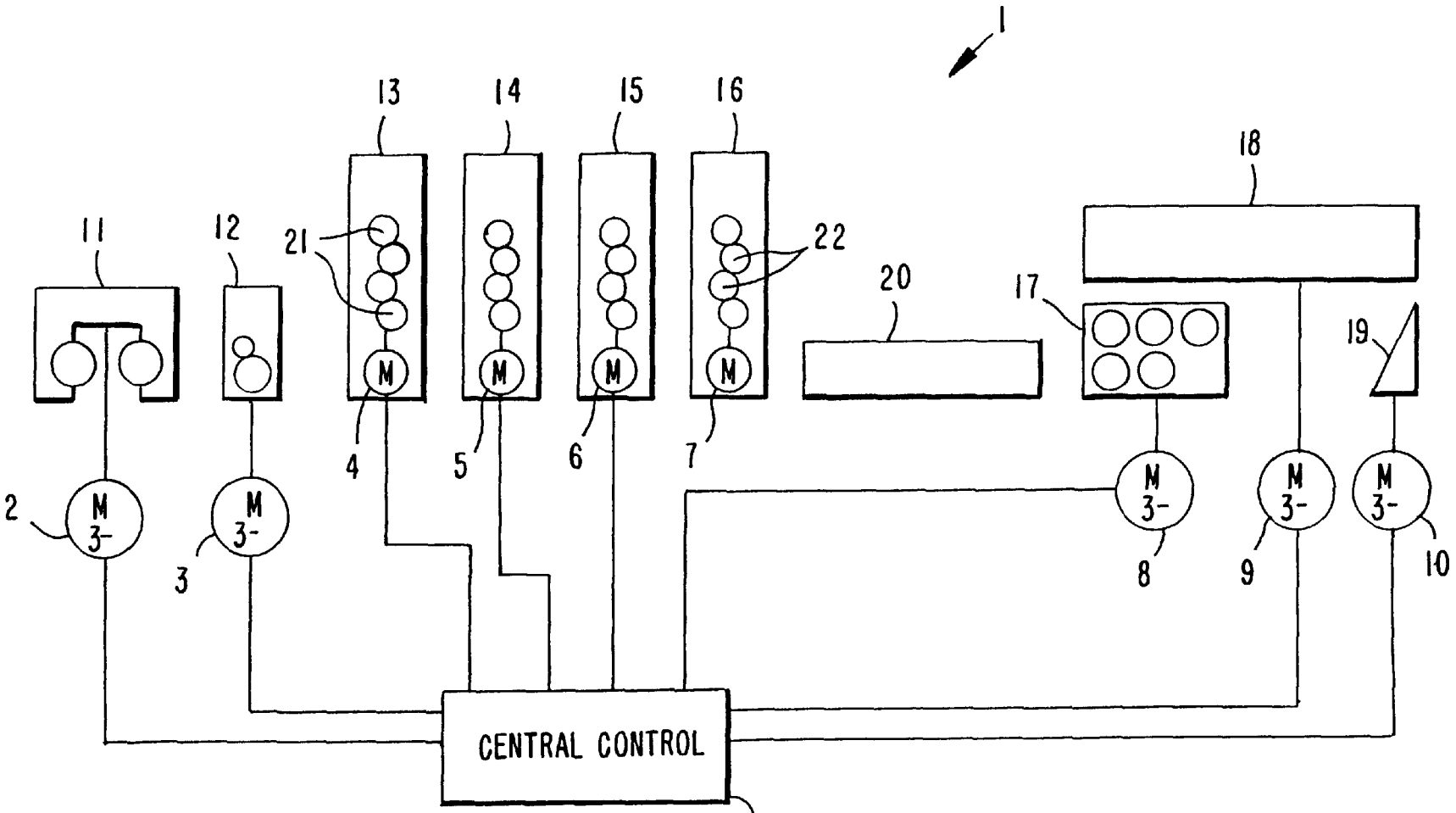
FIG. 1 shows a rotary offset printing machine with individual drives.

FIG. 1 shows a printing machine, i.e., a sheet-fed or rotary printing machine 1, which has a plurality of subsystems driven by the respective electric motors 2 to 10. The electric motors are three-phase asynchronous motors, for example. The subsystems are a roll changer 11, an insertion mechanism 12, printing groups 13 to 16, a cooling mechanism 17, a folding structure 18 and a folding apparatus 19. There is also a drier 20. The printing groups 13 to 16 each have two form cylinders 21 and two transfer cylinders 22. The form cylinders 21 and the transfer cylinders 22 are connected to one another and to the drive motors 4 to 7 via gearwheels. The printing machine 1 is controlled from a central control station 23. The central control station 23 also contains the superordinated control for the electric motors 2 to 10, whose specific electronic power and signal components are housed in the vicinity of or directly on the printing machine. Alternatively to the subsystems shown here, it is also possible for individual cylinders or rollers driven by their own respective electric motors to form a subsystem. Similarly, groups of cylinders or rollers, e.g., form and transfer cylinder pairs, or multiple rollers in an inking mechanism, can form such a subsystem.

Figure 2:
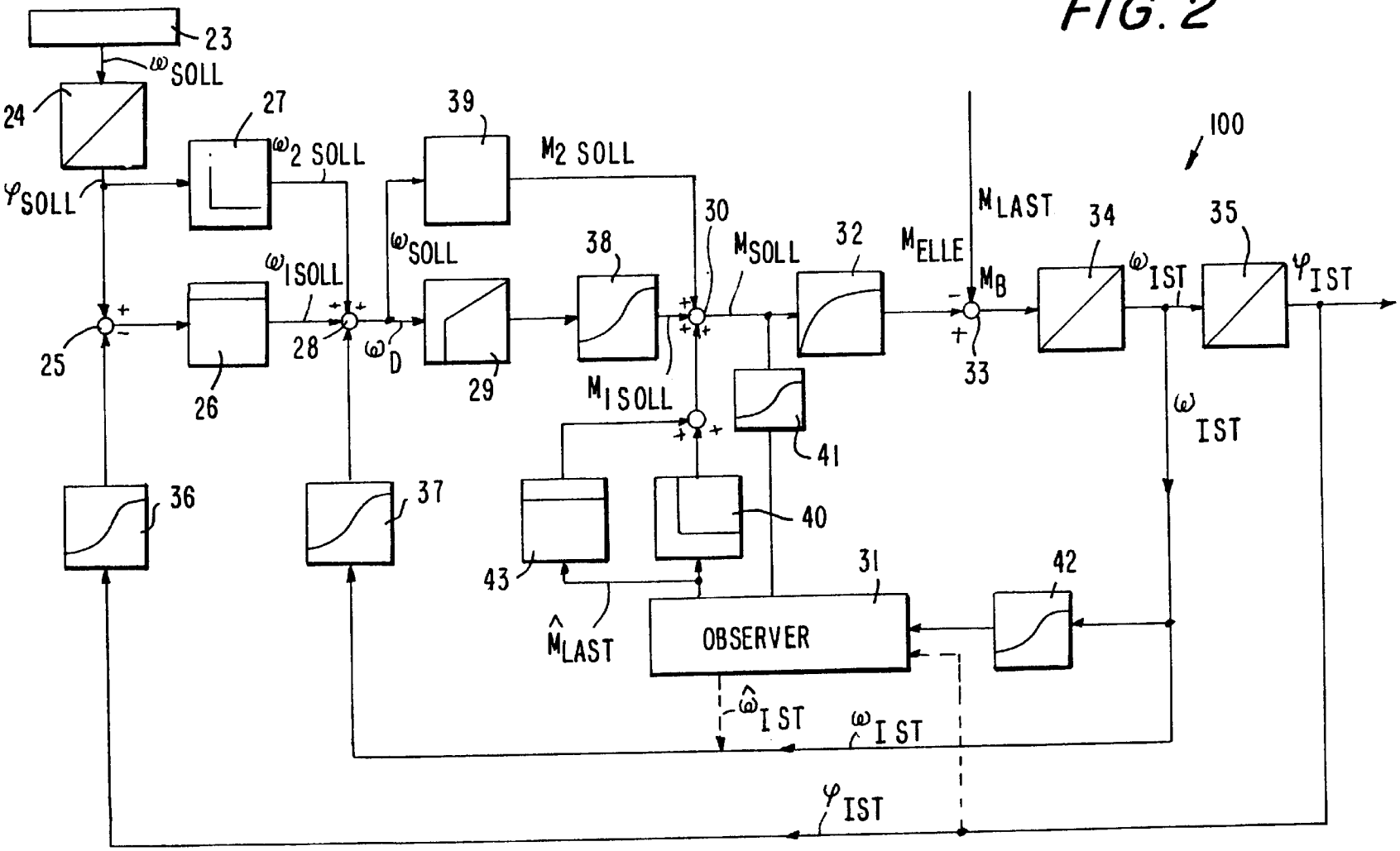
FIG. 2 shows a structural diagram of a control loop for an electric motor.

The target angular speed $\omega_{soll}$ is preset by the control panel 23 (FIG. 2). The target rotational angle $\phi_{soll}$ is obtained in an integrated element 24 from the target angular speed $\omega_{soll}$, and is supplied to all electric motors 2 to 10 at the summing point 25. There, the difference between the actual rotational angle $\phi_{ist}$ and the target rotational angle $\phi_{soll}$ is determined and supplied to an angle controller 26, which is a P controller, for example. The angle controller 26 produces a target angular speed $\omega_{1soll}$. Advantageously, the angle controller 26 is connected in parallel fashion to a differential element 27 that is also supplied with the target rotational angle $\phi_{soll}$ and that brings about a servocontrol of the target angular speed $\omega_{soll}$. The differential element 27 produces a target angular speed $\omega_{2soll}$, which, like the target angular speed $\omega_{1soll}$, is supplied to a summing point 28. The differential element 27 reduces the drag error, i.e., the deviation between the target rotational angle $\phi_{soll}$ and the actual rotational angle $\phi_{ist}$, and relieves the angle controller 26.

In addition to the target angular speeds $\omega_{1soll}$ and $\omega_{2soll}$, the e.g. filtered actual angular speed $\omega_{ist}$ is also supplied to the summing point 28, and is subtracted from the target angular speeds $\omega_{1soll}$ and $\omega_{2soll}$. The resulting differential angular speed $\omega_D$ is supplied, for example, to a P1 speed controller 29, i.e., a proportional and integrating controller, which determines a target motor torque $M_{1soll}$ from the differential angular speed $\omega_D$. The target motor torque $M_{1soll}$ is supplied to a summing point 30, where a load moment $\hat{M}_{LAST}$ produced by an observer 31, e.g. a subsystem observer, is added up. The target motor torque $M_{soll}$ resulting at the summing point 30 is the input variable for an adjustment element 32, which produces the torque $M_{Welle}$ that is available at the engine shaft of the electric motor. The adjustment element 32 contains, in addition to other parts known in themselves, a current rectifier in a regulating concept that takes into account the dynamic-and usually non-linear-properties of the electric motor.

At a summing point 33, the load torque $M_{Last}$ of the cylinders and/or rollers driven by a given electric motor, i.e., one of the electric motors 2 to 10, is subtracted from the torque $M_{Welle}$. The differential value $M_B$ of the summing point 33 is the acceleration moment that acts on the rotatory inertia of the motor, which is reproduced by an integrator 34, whose output variable, the actual angular speed $\omega_{ist}$, is integrated by integration in an integrator 35 to the actual rotational angle $\phi_{ist}$.

The actual angular speed $\omega_{ist}$ is supplied to the summing point 28 as well as to the observer 31. The observer 31 serves to compensate for the load torque $M_{Last}$. To minimize the effect of disturbances, be they periodic or non-periodic, it is assumed that the load torque $M_{Last}$ reacting on the electric motor will be compensated for as well as possible by the application of an opposing equally large "observed" load torque $\hat{M}_{LAST}$ at the input of the adjustment element 32. Ideal compensation would have the effect of making the motor angular speed and the motor rotational angle $\phi_{ist}$ impressed variables, i.e., variables completely independent of the connected load of the cylinders and rollers that result in the load torque $M_{Last}$. If no other disturbances were acting, the electric motors 2 to 10 would then behave, as a group, like a rigid mechanical shaft ("electronic shaft"). Thus, this idealized electric drive for the subsystems 11 to 19 of the printing machine 1 would have the same effect as the idealized assumed mechanical longitudinal shaft. However, such impressing of the angular speeds and motor shaft angles does not mean that the movement of the load masses is also impressed, because, as described above, the load masses are connected elastically to the motor shafts. Nor can even a mechanical longitudinal shaft be considered rigid. As is known, parameter-excited vibrations occur in some circumstances and can lead to printing errors, e.g., doubling. In the case of a mechanical longitudinal shaft, no direct influence on the load mass movement is possible. In contrast, the electronic shaft permits influence to be exercised on the load mass movement in such a way as to reduce the intrinsic movements that cause printing errors. This is possible by means of the differential application of $\hat{M}_{LAST}$ described below.

The observer 31 is defined as the replication either of part of the total system (subsystem observer), i.e., of one of the electric motors 2 to 10 including the adjustment element 32, or of the total system comprising the motor and the elastically connected load (total system observer). If the equivalent time constant of the adjustment element 32 is small, compared to the scan time of the observer 31 (i.e., the timepoints at which the actual angular speed $\omega_{ist}$ and the target torque $M_{soll}$ are supplied to the observer 31), then its reproduction, i.e., the block 32, can be omitted in the observer. This results in a simplified subsystem observer. So that the disturbance-related reconstruction error of the variable $\hat{M}_{LAST}$ becomes zero in the steady state, the subsystem observer 31 has a disturbance model. In the case of unknown non-periodic disturbances, an integrator is provided. In the case of periodic disturbances, an oscillator of the second order is provided. Preferably, for reasons of computer capacity, a disturbance model of the first order is implemented.

From the literature, e.g., the handbook "Abtastregelung" [Scanning Control] by J. Ackermann (3rd Edition), 1988, p. 203 ff, it is known how to realize an observer 31. From the moment target value $M_{soll}$ (or, substituting, from the electric current target value $I_{soll}$) and either the actual angular speed $\omega_{ist}$ (as in FIG. 2) or the actual rotational angle $\phi_{ist}$, the observer 31 calculates the load torque $\hat{M}_{LAST}$ and supplies this to the summing point 30, where it is added to the target torque $M_{1soll}$ to obtain the target torque $M_{soll}$. The observer 31 can also be used to find, from the rotational angle $\phi_{ist}$, the actual angular speed $\omega_{ist}$ in the form of the signal $\omega_{ist}$, and to supply this to the control station. In contrast to the calculation of $\omega_{ist}$ from $\phi_{ist}$ with the help of numerical differentiation, which is delayed, on the average, by a half scan period, $\omega_{ist}$ is reconstructed without delay.

Further, the observer can be equipped with a data storage device, in which the disturbance variables, e.g., the folding blade movement and folding flap movement in the folding mechanism 19, or the channel and vibrator reactions in the printing groups 13 to 16, are stored. The stored data are updated on an ongoing basis, and thus adjusted to the given speed of the printing machine 1. The load torque $\hat{M}_{LAST}$ is derived from the stored information as a compensation signal and is applied to the summing point 30 of the adjustment element with such a phase position as to attain a minimum of the drag error, i.e., of the difference between the target and actual values, at the output of the summing point 25. The phase position of the compensation signal is preset, using the zero pulse of an angular speed indicator connected to a given electric motor 2 to 10, during the start up of the printing machine 1, e.g., during the adjustment phase for ink density, etc., and is then automatically adapted in a learning fashion to the given machine speed.

Because the described disturbances that can lead to printing errors do not act directly on the drive motor, but rather on the elastically linked load mass, the application of the observed moment $\hat{M}_{LAST}$ can be carried out via a differentiating filter 40. This measure makes it possible to counteract the periodic or non-periodic disturbance moment acting on the load with a compensating share quickly enough to permit optimization of the disturbance behavior of the load mass. This cannot be done with an elastic mechanical longitudinal shaft in the absence of a suitable adjustment variable.

To damp the noise portion of the output signal, which is increased by the differentiating filter 40 in a certain frequency range, deep pass filters 41, 42 can be provided on the input variables of the observer.

Alternatively, the differential filter can be expanded by a smoothing part. In addition, a proportional element 43 can be connected in parallel fashion and used, given suitable design, to damp the resonance point between the motor and the elastically linked load.

To further improve the signals, there are filters 36, 37 and 38 (e.g., deep pass filter, curb filter and differential filter) that smooth the actual rotational angle $\phi_{ist}$, the actual angular speed $\omega_{ist}$ and the target torque $M_{1soll}$ produced by the P1 speed controller 29. These filters 36 to 38 can be used to damp resonance points. This results in a low-vibration drive that improves the quality of products printed with the printing machine 1, and also increases the useful life of the mechanical and electric components in the printing machine 1.

In addition or alternatively to the observer 31, the control loop contains, for the purpose of controlling one of the electric motors 2 to 10, a periodic compensation controller 39. At its output, the periodic compensation controller 39 furnishes an auxiliary target torque value $M_{2soll}$ that is automatically adjusted, in the manner of an controller part, in such a way as to minimize the drag error. The periodic controller part is characterized by a share $1/(z^n-1)$ in the control transmission function and is determined by the presumably known period duration of a disturbance (Tomizuka, Masayoshi, Hu, Jwusheng: "Adaptive Asymptotic Tracking of Repetitive Signals—A Frequency Domain Approach" in IEEE Transactions on Automatic Control, October 1993, Vol. 38, No. 10, pp. 1572 to 1579). The differential angular speed $\omega_D$ is supplied to the compensation controller 39 as well as to the speed controller 29. From this, the compensation controller 39 obtains data on periodic disturbances, e.g., the impact of the vibrator in the inking mechanism, the movement of folding blades and folding flaps in the folding mechanism 19, the channel impact of form and transfer cylinders 21, 22 etc., and takes these into account in producing the target torque $M_{2soll}$. The compensation controller 39 is capable of learning, and optimizes the target torque $M_{2soll}$ in such a way that the input value of the compensation controller 39, i.e., the differential angular speed $\omega_D$, has the smallest possible periodic shares. The observer 31 and the compensation controller 39 can be embodied completely or in part with neural networks and/or fuzzy logic, thus obtaining adaptive properties. With the help of genetic algorithms, automatic parameter determination is possible. Descriptions of such intelligent control systems are found, for example, in the following:

M. Gupta and N.K. Sinha (eds.): *Intelligent Control Systems, Theory and Applications*, Chapter 3, pp. 63–85 and Chapter 13, pp. 327–344.

T Baeck, G. Rudolph and H.P. Schwefel: "Evolutionary Programming and Evolutionary Strategies: Similarities and Differences" in Proc. of Second Annual Conference on Evolutionary Programming (D. Fogel and W. Atmar, eds.), San Diego Calif., pp. 11–22, Evolutionary Programming Society, February 1993.

J. -Y. Jeon, J. -H. Kim and K. Koh: "Evolutionary-Programming-Based Fuzzy Precompensation of PD Controllers for Systems with Deadzones and Saturations" in Proc. First International Symposium on Fuzzy Logic (N.C. Steele, ed.), pp. C2–C9, ICSC Academic Press, May 1995.

The invention is not limited by the embodiments described above which are presented as examples only but can be modified in various ways within the scope of protection defined by the appended patent claims.

We claim:

1. A printing machine, comprising:

printing groups;

a plurality of electric motors, each of the electric motors being arranged to drive at least parts of a respective one of the printing groups; and a plurality of control loops, a respective one of the control loops being in operative communication with a respective one of the electric motors so as to control actual angular speed of the respective electric motor, each control loop including observer means for obtaining an observed target load that is supplied to the electric motor as a component of the target torque from one of the actual angular speed and an actual rotational angle as well as a target torque of the electric motor, the observer means further obtaining an observed angular speed that is added to a target angular speed, each control loop further including periodic compensation controller means for compensating for periodic disturbances, the periodic compensation controller means being operative to compensate for at least one of channel impacts of form and transfer cylinders having clamping channels, periodic disturbances of a vibrator in an inking mechanism, a cutting blade for cross-cutting a printing web, and a folding knife for producing a fold.

2. A printing machine as defined in claim 1, wherein the control loop includes means for damping resonance points in the actual angular speed, in the actual rotational angle and in the component of the target torque of the electric motor.

3. A printing as defined in claim 1, wherein the observer and the compensation controller means, respectively, are learning-capable systems which are adapted in a controlled manner to one of the actual angular speed and the target angular speed, the learning-capable systems being at least one of neural networks and fuzzy logic systems which are capable of automatic adaptation of parameters.

4. A printing machine as defined in claim 1, and further comprising at least one of a differentiating filter and a proportional element connected to the observer so that the target load moment runs from the observer via at least one of the differentiating filter and the proportional element.

5. A printing machine as defined in claim 1, and further comprising filter means for smoothing the actual rotational angle, the actual angular speed and the target torque.

6. A printing machine as defined in claim 3, wherein the at least one of the differentiating filter and the proportional element has a further filter for signal smoothing.

7. A printing machine as defined in claim 1, and further comprising at least one of a roll changer, an insertion mechanism, a cooling mechanism, a folding structure and a folding apparatus, these components each having at least one of cylinders and rollers, one of individual of the cylinders and rollers and groups of the cylinders and rollers, respectively, are driveable by a separate controlled electric motor.

* * * * *